US008104528B2

(12) United States Patent
Tsuchiya et al.

(10) Patent No.: US 8,104,528 B2
(45) Date of Patent: Jan. 31, 2012

(54) VACUUM DIE CASTING METHOD AND VACUUM DIE CASTING APPARATUS

(75) Inventors: Shoichi Tsuchiya, Toyota (JP); Norihiro Amano, Kasugai (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 214 days.

(21) Appl. No.: 12/296,416

(22) PCT Filed: Oct. 11, 2007

(86) PCT No.: PCT/JP2007/069856

§ 371 (c)(1),
(2), (4) Date: Nov. 18, 2008

(87) PCT Pub. No.: WO2008/044736

PCT Pub. Date: Apr. 17, 2008

(65) Prior Publication Data

US 2009/0194246 A1 Aug. 6, 2009

(30) Foreign Application Priority Data

Oct. 12, 2006 (JP) ..... 2006-279282

(51) Int. Cl.
*B22D 17/14* (2006.01)
*B22D 27/15* (2006.01)

(52) U.S. Cl. ..... 164/61; 164/113; 164/254; 164/312

(58) Field of Classification Search ..... 164/61, 164/63, 65, 253, 254, 256, 113, 312
See application file for complete search history.

(56) References Cited

U.S. PATENT DOCUMENTS

| | | | | |
|---|---|---|---|---|
| 5,246,055 | A * | 9/1993 | Fields et al. | 164/61 |
| 5,329,983 | A * | 7/1994 | Cook | 164/97 |
| 5,860,468 | A | 1/1999 | Cook | |
| 6,070,643 | A * | 6/2000 | Colvin | 164/61 |
| 6,253,828 | B1 * | 7/2001 | Reiter | 164/61 |
| 6,308,766 | B1 * | 10/2001 | Thurner | 164/61 |
| 6,648,054 | B2 * | 11/2003 | Kuramasu et al. | 164/61 |

FOREIGN PATENT DOCUMENTS

| | | | |
|---|---|---|---|
| DE | 10 2004 057324 | A1 | 6/2006 |
| DE | 10 2004 057325 | A1 | 6/2006 |
| EP | 0 901 853 | A1 | 3/1999 |
| JP | 62-207554 | A | 9/1987 |
| JP | 4-507218 | A | 12/1992 |
| JP | 2002-224807 | A | 8/2002 |
| JP | 2002-346717 | A | 12/2002 |
| JP | 2003-001391 | A | 1/2003 |
| JP | 2004-074167 | A | 3/2004 |
| SU | 656 737 | A2 | 4/1979 |

* cited by examiner

*Primary Examiner* — Kevin P Kerns
(74) *Attorney, Agent, or Firm* — Kenyon & Kenyon LLP

(57) ABSTRACT

A vacuum die casting method according to the present invention solves the problems relating to seal performance, differential pressure, and the stability of the degree of vacuum. The method carries out the casting with a casting cavity evacuated. In the method, a molten metal is poured from a molten metal inlet of a plunger sleeve, followed by forming a vacuum chamber surrounding the inlet and an open end of the plunger sleeve located on the opposite side of the die, and an evacuation of the vacuum chamber and the cavity starts before starting an operation of a plunger tip. When the evacuation starts, the plunger tip is positioned between the open end of the plunger sleeve and the inlet so that the vacuum chamber is communicated to the inside of the plunger sleeve through the inlet.

8 Claims, 4 Drawing Sheets

VACUUM DIE CASTING METHOD AND VACUUM DIE CASTING APPARATUS

This is a 371 national phase application of PCT/JP2007/069856 filed Oct. 11, 2007, which claims priority to Japanese Patent Application No. 2006-279282 filed Oct. 12, 2006, the contents of which are incorporated herein by reference.

FIELD OF THE INVENTION

The present invention relates to vacuum die casting methods and vacuum die casting apparatuses.

BACKGROUND OF THE INVENTION

Conventionally, in the field of vacuum die casting, air is prevented from leaking into the cavity of the die out of the backside of the plunger tip. For example, JPA-2002-224807 discloses such an art.

However, in the conventional method disclosed in JPA-2002-224807, it may fail to close an opening of the end of a plunger sleeve and an opening of the molten metal inlet.

Concretely, with regard to the opening of the end of the plunger sleeve, the opening is closed by sliding a vacuum sleeve in the plunger sleeve, which results in deformation or expansion caused by the heat of the plunger sleeve. So, the distance, between the vacuum sleeve and plunger sleeve, changes; as a result, the seal performance will be degraded.

With regard to the opening of the molten metal inlet, the molten metal will be slopped around the inlet. So, the shutter or the like provided with the opening may fail to sufficiently seal the opening.

In the conventional method disclosed in JPA-2002-224807, in closing the openings of the end of the plunger sleeve and of the inlet, both of the space behind the plunger tip and the cavity are evacuated. However, there is a volume difference among the space and the cavity or there is a route resistance, so that it is difficult to keep constant the degrees of vacuum in the space and cavity; as a result, there exists a pressure differential therebetween. Unfortunately, this pressure differential will cause the penetration of the molten metal into the gap between the plunger tip and plunger sleeve or into the space behind the plunger tip. Accordingly, it causes galling at the plunger tip, sliding failure of the plunger tip or the like.

In the conventional vacuum die casting method, it is difficult to reach the required vacuum degree in the whole space including the cavity and plunger sleeve within the prescribed time due to the large volume of the cavity or the complex conduit to the cavity.

Considering the freezing of the molten metal in the plunger sleeve, the evacuation time may be around one second, so that there seems a variation in degrees of vacuum.

When the die casting is operated under the situation where the variation in the vacuum degree exists, the product will lack quality stability.

SUMMARY OF INVENTION

Problems to Be Solved By the Invention

The objective of the present invention is to provide a vacuum die casting method and a vacuum die casting apparatus enabled to solve the problems regarding the seal performance, pressure differential, and the stability of the degree of vacuum.

Means of Solving the Problems

The objective of the present invention is mentioned above, and the means of solving the problems will be described below.

The first aspect of the present invention is a vacuum die casting method carrying out the casting with a casting cavity evacuated, in which a molten metal is poured from a molten metal inlet of a plunger sleeve, followed by forming a vacuum chamber surrounding the inlet and an open end of the plunger sleeve that is on the opposite side of the die, and an evacuation of the vacuum chamber and the cavity starts before an operation of a plunger tip starts.

Preferably, when the evacuation starts, the plunger tip is positioned between the open end of the plunger sleeve and the inlet so that the vacuum chamber is communicated to the inside of the plunger sleeve through the inlet.

The second aspect of the present invention is a vacuum die casting apparatus comprising a closure member forming a vacuum chamber surrounding the inlet and an open end of the plunger sleeve that is on the opposite side of the die, in which a molten metal is poured from a molten metal inlet of a plunger sleeve, followed by forming a vacuum chamber by utilizing the closure member, and an evacuation of the vacuum chamber and the cavity starts before an operation of a plunger tip starts.

Preferably, when the evacuation starts, the plunger tip is positioned between the open end of the plunger sleeve and the inlet so that the vacuum chamber is communicated to the inside of the plunger sleeve through the inlet.

Preferably, the closure member is formed in a tubular shape, having an open end at one side to which the plunger tip moves in an injection and having a closed end provided with a hole into which a shaft of the plunger tip inserts. The internal dimension of the closure member is larger than the external dimension of the plunger sleeve. When the open end of the closure member is moved toward the moving direction of the plunger tip, the open end of the plunger sleeve is inserted into an internal space of the closure member.

Preferably, the plunger sleeve is provided with a flange at an outer surface thereof, and the vacuum chamber is formed by pressing and fixing the open end of the closure member to the flange.

Preferably, a fixing platen of the casting die is provided with a flange, and the vacuum chamber is formed by pressing and fixing the open end of the closure member to the flange.

Preferably, the closure member, the plunger sleeve, the plunger tip and the shaft are arranged coaxially.

Effect of the Invention

According to the first aspect of the present invention, the start timing of evacuation becomes earlier, and after starting the evacuation, the efficient evacuation can be achieved. The plunger sleeve and casting cavity can be evacuated in a short period. The evacuation to the desired level can be operated with stability.

Moreover, the space of the front side and backside of the plunger tip seem to be substantially equally evacuated via the inlet before the plunger tip is injected, so that the presence of pressure differential between the spaces is prevented. Accordingly, the problems are avoided, such as the penetration of the molten metal into the gap between the plunger tip and plunger sleeve.

According to the second aspect of the present invention, the start timing of evacuation becomes earlier, and after starting the evacuation, the efficient evacuation can be achieved. The plunger sleeve and casting cavity can be evacuated in a short period. The evacuation to the desired level can be operated with stability.

Moreover, the space of the front side and backside of the plunger tip seem to be substantially equally evacuated via the inlet before the plunger tip is injected, so that the presence of pressure differential between the spaces is prevented. Accordingly, the problems are avoided, such as the penetration of the molten metal into the gap between the plunger tip and plunger sleeve.

Moreover, the present invention facilitates the configuration.

Moreover, the flange can serve as a stopper of the closure member and as a seal member of the vacuum chamber. Without touching the plunger sleeve and inlet, the vacuum chamber can be formed at the side of the open end of the plunger sleeve. Additionally, the flange can securely seal regardless of the thermal strain of the plunger sleeve or the dirtiness of the inlet.

Moreover, the vacuum die casting apparatus can be downsized.

EXPLANATION OF NUMERALS

Figure 1:
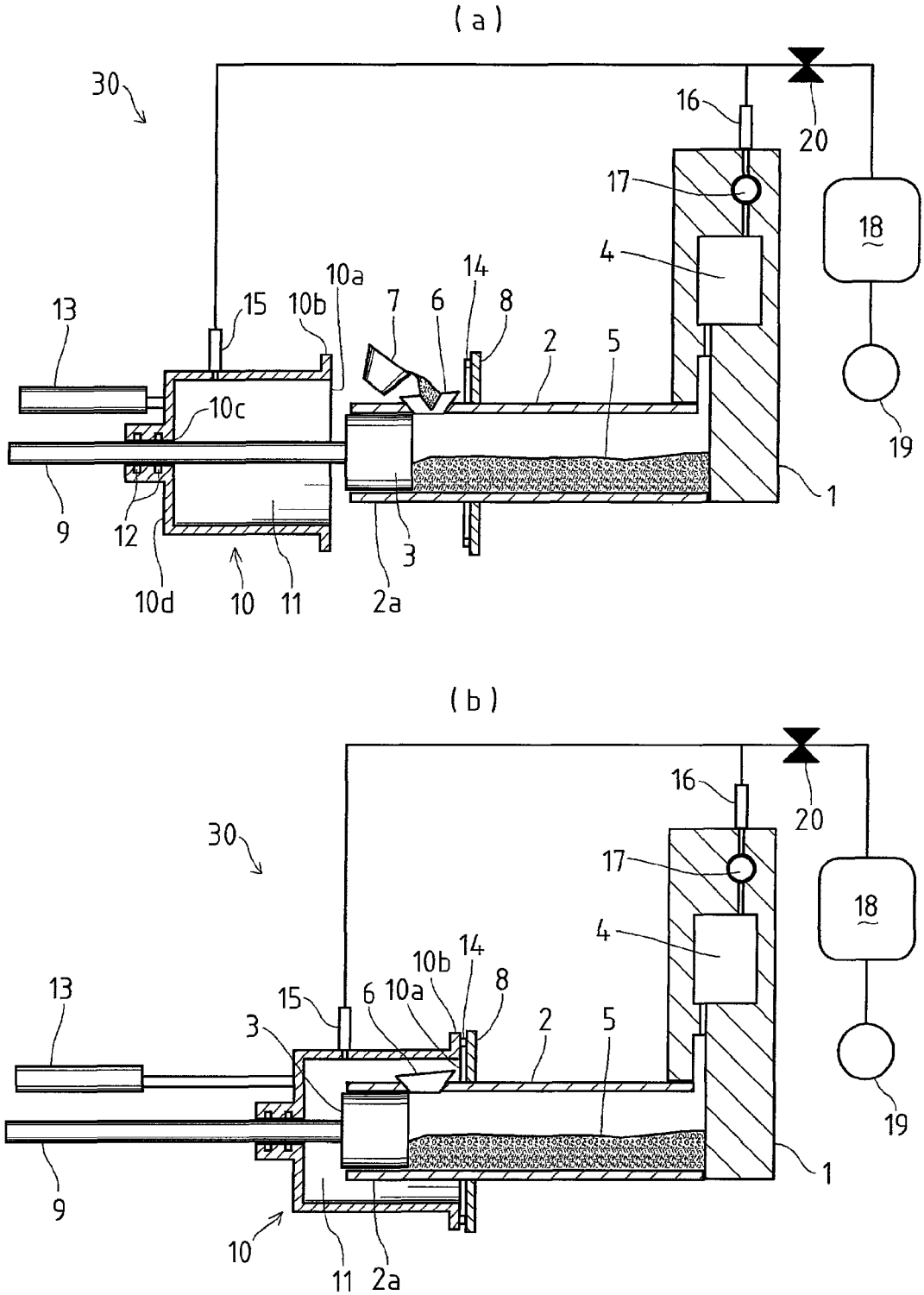
FIG. 1 is a schematic illustration of a vacuum die casting apparatus: (a) shows pouring a molten metal, and (b) shows starting evacuation.

1 casting die
2 plunger sleeve
2*a* open end
3 plunger tip
4 casting cavity
6 molten metal inlet
7 ladle
10 closure member
11 vacuum chamber
30 vacuum die casting apparatus

DETAILED DESCRIPTION

The best mode for carrying out the invention will be described.

FIGS. 1(*a*) and 1(*b*) illustrate a vacuum die casting apparatus 30.

As shown in FIG. 1(*a*), a casting die 1 is provided with a plunger sleeve 2 through a fixed platen (not shown). In the plunger sleeve 2, a plunger tip 3 slides to press a molten metal 5 into a casting cavity 4, which is defined in the casting die 1.

As shown in FIG. 1(*a*), the plunger sleeve 2 has a molten metal inlet 6 where the molten metal 5 is poured into the plunger sleeve 2 from a ladle 7.

The plunger sleeve 2 is provided with a flange 8 at the outer surface thereof. The flange 8 is arranged to form the face, which is substantially rectangular with respect to the actuating direction of the plunger tip 3. The flange 8 is disposed between the inlet 6 and the casting die 1; in other words, the flange 8 is displaced from the inlet 6 toward the injection direction of the plunger tip 3 to press the molten metal.

As shown in FIG. 1(*b*), the plunger tip 3 is provided with a shaft 9. The shaft 9 is coaxially provided with a closure member 10, which defines a vacuum chamber 11.

The closure member 10 is formed in a tubular shape and has an open end 10*a* and a closed end 10*d*. The open end 10*a* is arranged to face to the flange 8. The closed end 10*d* has a hole 10*c* where the shaft 9 slidably penetrates.

The internal dimension of the closure member 10 is larger than the external dimension of the plunger sleeve 2. The open end 10*a* of the closure member 10 is moved toward the injection direction of the plunger tip, and then an open end 2*a* of the plunger sleeve 2 is inserted into the closure member 10.

The open end 10*a* of the closure member 10 is provided with a flange 10*b*. When the flange 10*b* is pressed and fixed to the flange 8 of the plunger sleeve 2, the vacuum chamber 11 is defined surrounding the open end 2*a* of the plunger sleeve 2.

In this embodiment, the closure member 10, the plunger sleeve 2, the plunger tip 3, and the shaft 9 are arranged coaxially, so that the vacuum die casting apparatus 30 is downsized.

As shown in FIG. 1(*a*), the shaft 9 is actuated with the actuator (not shown), e.g. an air cylinder or a hydraulic cylinder. The plunger tip 3 arranged at the tip of the shaft 9 slides telescopically in the plunger sleeve 2.

As shown in FIG. 1(*a*), the shaft 9 is slidably fitted into the hole 10*c* formed at the closed end 10*d* of the closure member 10. The hole 10*c* is provided with a seal member 12, e.g. an O-ring.

As shown in FIGS. 1(*a*) and 1(*b*), the closure member 10 is actuated by an actuator 13, e.g. an air cylinder or a hydraulic cylinder, to keep coaxial with respect to the plunger tip 3 or the shaft 9.

The actuator 13 is controlled independently regarding the plunger tip 3 or the shaft 9, so that the closure member 10 and the plunger tip 3 move independently from each other.

As shown in FIGS. 1(*a*) and 1(*b*), in the flange 8 provided around the plunger sleeve 2, there provides a seal member 14, e.g. an O-ring, at the face of the flange 8 facing to the flange 10*b* of the closure member 10. When the flanges 8 and 10*b* are pressed and fixed together, the seal member 14 seals the clearance between them. It should be noted that the seal member 14 could be provided at the flange 10*b*.

The flanges 8 and 10*b* serve as a stopper of the closure member 10 and as a seal material of the vacuum chamber 11.

The closure member 10 moves outside of the plunger sleeve 2, so the lubricant is unnecessary between them.

The seal material composed of the flanges 8 and 10*b* is disposed outside of the plunger sleeve 2, so the flanges 8 and 10*b* are prevented from thermal deformation caused by the heat of the molten metal. As a result, the seal performance is secured.

The closure member 10 defines the vacuum chamber 11 without contacting the inlet 6, so the problems are avoided; such as degradation of the seal performance caused by the metal molten adheres to the inlet 6. As a result, the required degree of vacuum is secured, and maintenance-free seal is realized.

As shown in FIGS. 1(*a*) and 1(*b*), the closure member 10 is provided with a vacuum opening 15 for evacuation of the vacuum chamber 11.

It should be noted that the vacuum opening 15 could be disposed at the flange 8. When the closure member 10 is set as shown in FIG. 1(*b*), the vacuum chamber can be evacuated through the vacuum opening 15. In this case, the pipe installation connecting to a vacuum tank 18 is fastened.

The casting die 1 is provided with a vacuum opening 16, which communicates into the cavity 4 and evacuates the cavity 4. The path from the cavity 4 and the vacuum opening 16 has a shut valve 17.

The vacuum openings 15 and 16 are connected with a vacuum pump 19 through a valve 20 and the vacuum tank 18. Operating the valve 20 starts the evacuation of the cavity 4 and vacuum chamber 11. In this case, the vacuum tank 18 works as a buffer.

In the vacuum die casting apparatus 30 shown in FIGS. 1(*a*) and 1(*b*), it is preferable to control sequentially all of the ladle 7, plunger tip 3, closure member 10 (the actuator 13), shut valve 17, valve 20, and the vacuum pump 19.

For example, after pouring the molten metal, the ladle 7 is moved backward, at the same time the actuator 13 actuates the closure member 10 forward to contact to the flange 8, and then the vacuum chamber 11 is formed. After injection, the plunger tip 3 is moved backward, at the same time or followed by actuating the closure member 10 backward.

It should be noted that the configuration of the control of this embodiment is not limited.

The vacuum die casting method will be described below referring FIG. 2.

Figure 2:
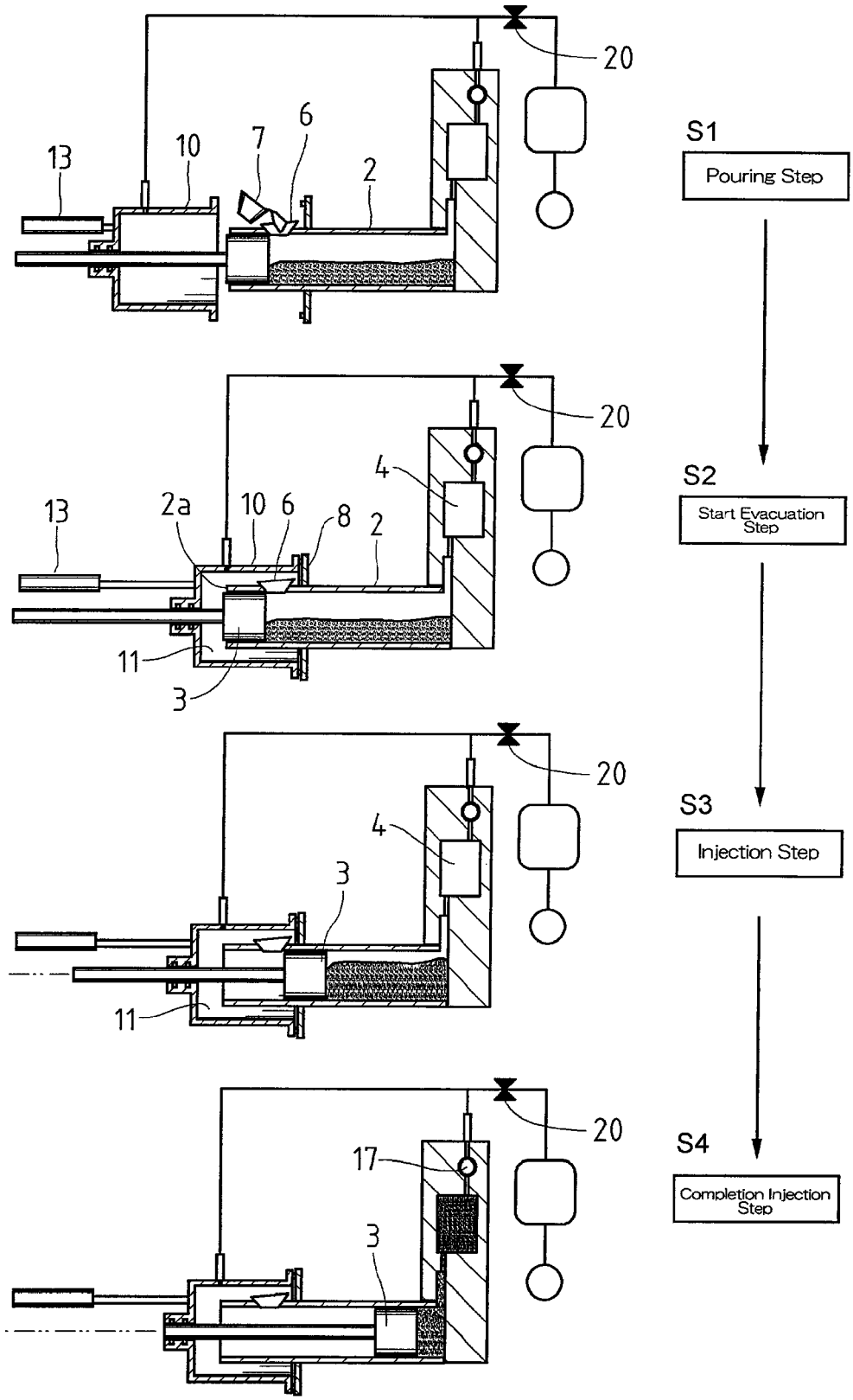
FIG. 2 is showing a vacuum die casting sequence.

First, in a pouring step S1 shown in FIG. 2, the molten metal is poured into the plunger sleeve 2 with the ladle 7.

In the pouring step, the closure member 10 is moved backward by the actuator 13 to separate from the plunger sleeve 2. The plunger tip 3 is disposed so as to position the tip thereof at the backside of the inlet 6, so that the inlet 6 is completely open. The valve 20 is closed and the evacuation is not started.

Second, in a start evacuation step S2 shown in FIG. 2, the evacuation is started.

In the start evacuation step S2, the closure member 10 is pressed and contacted to the flange 8 of the plunger sleeve 2 by the actuator 13. Thus, the open end 2*a* of the plunger sleeve 2 and the inlet 6 are disposed in the vacuum chamber 11 of the closure member 10. In this situation, the space backside of the plunger tip 3 (the opposite side with respect to the side where the molten metal touches) is communicated to the space in the plunger sleeve 2 via the inlet 6.

Thus, when the evacuation is started, the plunger tip 3 is positioned between the open end 2*a* of the plunger sleeve 2 and the inlet 6. The vacuum chamber 11 is communicated to the inside of the plunger sleeve 2 via the inlet 6.

In the start evacuation step S2; the molten metal poured with ladle 7 waves, so that it is laid for a brief period (e.g. one or two minutes) to smooth the molten metal.

In smoothing the molten metal or after finishing the smoothing, the valve 20 is opened, and then the evacuation of the vacuum chamber 11 and cavity 4 is started.

Here, the evacuation will be started before the plunger tip 3 is actuated to inject the molten metal. Thus, the evacuation is started before the plunger tip 3 shut the inlet 6. In the evacuation process, the vacuum chamber 11 is communicated to the plunger sleeve 2 via the inlet 6, so that the air in the plunger sleeve 2 is evacuated through the cavity 4 and the inlet 6.

The start timing of evacuation of the plunger sleeve 2 is set before starting the injection of the plunger tip 3. Therefore, the plunger sleeve 2 can be evacuated through both of the cavity 4 and inlet 6.

Thus, the start timing of evacuation is forwarded and effective evacuation is achieved after starting the evacuation. Therefore, the plunger sleeve 2 and cavity 4 are evacuated in a short period, or the evacuation period becomes longer.

Figure 3:
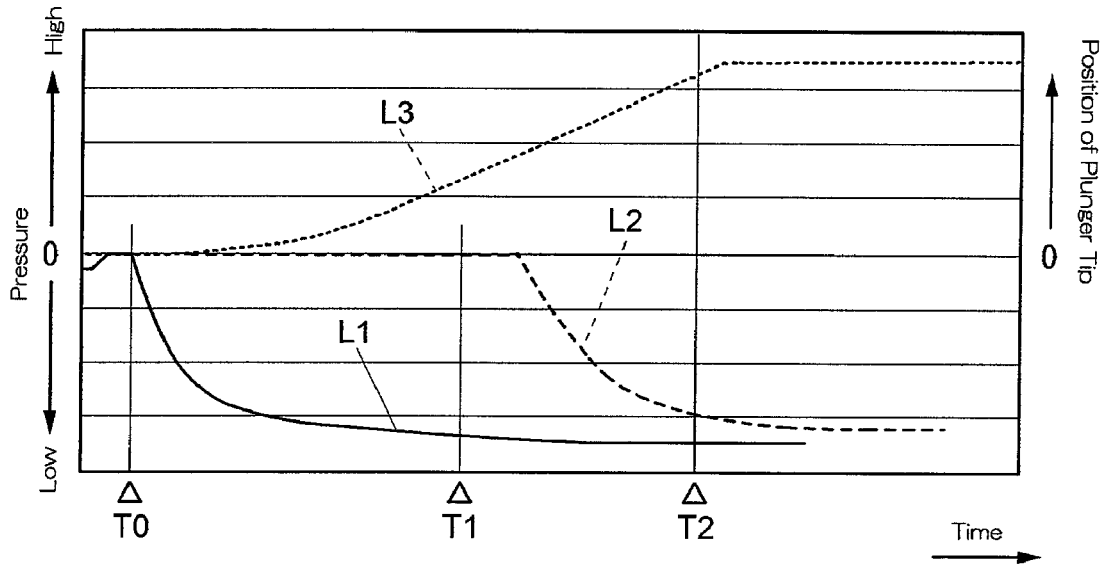
FIG. 3 is showing an example of change of the pressure, the axis of abscissa is time and that of ordinate is pressure.

Comparing the evacuation curves L1 and L2 shown in FIG. 3 can represent the effects of the vacuum die casting method. It should be noticed that the evacuation curves are plotted by the low-speed injection, not by the high-speed injection, to compare the degree of vacuum.

In this example, the evacuation curve L1 represents this embodiment according to the present invention and the evacuation curve L2 represents the conventional embodiment. The axis of abscissa is time and that of ordinate is pressure in the cavity. The evacuation curve L3 represents the position of the plunger tip 3, and the high-speed injection starts at the target time T2.

As shown by the evacuation curve L1, in this embodiment, the start timing of evacuation can be set at the time T0 (for example, the timing after smoothing the molten metal). That is to say, the evacuation can be started when the plunger tip 3 is positioned in the initial position.

As shown by the evacuation curve L2, in the conventional embodiment in which the evacuation starts after the plunger tip passes through the inlet, the evacuation starts at the time T1, which is later than the time T0, and the pressure at the target time T2 is higher than that of the evacuation curve L1.

As described above, the start timing of evacuation becomes earlier in this embodiment, so the degree of vacuum at the target time T2 can become lower.

In this embodiment, in addition to the start timing of evacuation, the evacuation is performed through both the cavity 4 and inlet 6. So, the evacuation can be effectively performed, and finally the degree of vacuum will be upgraded.

Third, in an injection step S3 as shown in FIG. 2, the molten metal is injected.

The plunger tip 3 is moved by the actuator (not shown), and then the molten metal is injected into the cavity 4, where secures the desired pressure. During the injection, the valve 20 is kept opening, and the evacuation of the cavity 4 and vacuum chamber 11 continues.

Here, when the plunger tip 3 passes through the inlet 6, the space inside the plunger sleeve 2 is separated into the space behind the plunger tip 3 and the other space, that is cavity 4 side space. In both the spaces, the evacuation is carried out through the inlet 6, so the pressures in the both spaces are substantially same. Therefore, the penetration of the molten metal is prevented into the gap between the plunger sleeve 2 and plunger tip 3.

Forth, in a completion injection step S4 as shown in FIG. 2, the injection is completed.

In this situation, the molten metal is injected with high-speed, and then the shut valve 17 is closed.

When the plunger tip 3 is completely moved toward the injection direction, the valve 20 is closed so that the evacuation is finished.

After the product freezes in the cavity 4, the casting die is opened and the product is removed.

The plunger tip 3 is replaced after the complete injection step. Accordingly, the backside of the plunger tip 3 sweeps the dusts, chips of metal or the like in the plunger sleeve 2, so that they are removed from the open end 2*a* of the plunger sleeve 2.

Thus, the movement of the plunger tip 3 cleans the inner peripheral of the plunger sleeve 2 when replacing the plunger tip 3.

As a result, the inclusion of contaminant is prevented at the next injection. Finally, the quality stability is improved.

As mentioned above, in the vacuum die casting method in accordance with the present invention, as shown in FIGS. 1 (*a*) and 1 (*b*), the molten metal is poured from the molten metal inlet 6 of a plunger sleeve 2, followed by forming the vacuum chamber 11 surrounding the inlet 6 and the open end 2*a* of the plunger sleeve 2 that is on the opposite side of the casting die 1, and the evacuation of the vacuum chamber 11 and the casting cavity 4 starts before the operation of the plunger tip 3 starts.

Furthermore, in the vacuum die casting apparatus 30 according to the embodiment, it comprises the closure member 10 forming the vacuum chamber 11 surrounding the inlet 6 and the open end of the plunger sleeve 2*a* that is on the opposite side of the casting die 1 and comprises the vacuum tank 18 and vacuum pump 19 evacuating the vacuum chamber 11 and casting cavity 4. The closure member 10 defines the vacuum chamber 11 after the molten metal is poured into the plunger sleeve 2 through the inlet 6. The vacuum chamber is evacuated, followed by the injection of the plunger tip 3.

Accordingly, the start timing of evacuation becomes earlier; after starting the evacuation, the efficient evacuation can be achieved. The plunger sleeve 2 and casting cavity 4 can be evacuated in a short period. The evacuation to the desired level can be operated with stability.

Moreover, the space of the front side and backside of the plunger tip 3 seem to be substantially equally evacuated via the inlet 6 before the plunger tip 3 is injected, so that the presence of pressure differential between the spaces is prevented. Accordingly, the problems are avoided, such as the penetration of the molten metal into the gap between the plunger tip 3 and plunger sleeve 2.

Figure 4:
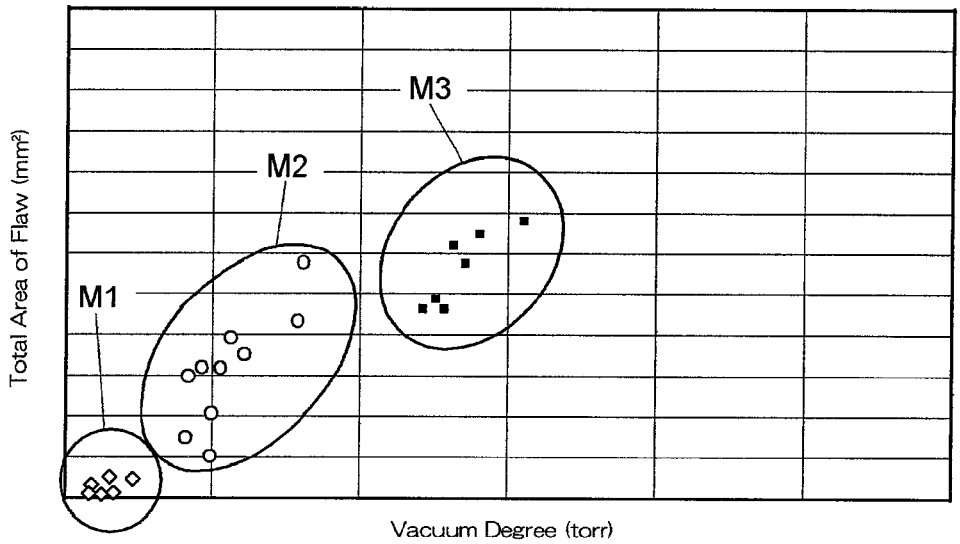
FIG. 4 is showing a relationship between the vacuum degree and the total area of flaw of the product, the axis of abscissa is the vacuum degree and that of ordinate is the total area of flaw of the product.

The effects mentioned above can be lead to the improvement of product quality. For example, FIG. 4 shows the relationship between a vacuum degree that is achieved at a target time and a total area of flaw existing in the product, which is cast under the vacuum degree. As shown in FIG. 4, the total area of flaw in the group M1 where the desired vacuum degree is secured is smaller than the groups M2 and M3 where the desired vacuum degree is not achieved. Carrying out the experiment shows the relationship shown in FIG. 4.

Figure 5:
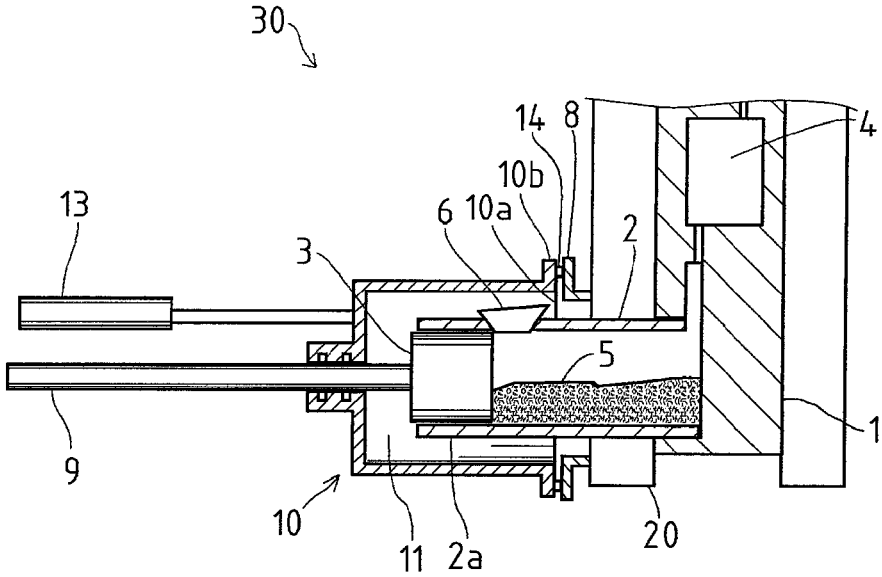
FIG. 5 is a schematic illustration of the vacuum die casting apparatus, which has the alternative flange.

Additionally, the arrangement of the flange 8 is not limited at the outer surface of the plunger sleeve 2. The flange 8 can be arranged where it can contact to the flange 10*b* of the closure member 10 and the flanges 8 and 10*b* can form the vacuum chamber by pressing and fixing them. In one embodiment, as shown in FIG. 5, the flange 8 is provided with the fixing platen 40, to which the casting die 1 is fixed.

INDUSTRIAL APPLICABILITY

The present invention is applicable to the vacuum die casting methods and vacuum die casting apparatuses.

The invention claimed is:

1. A vacuum die casting method for carrying out casting with a casting cavity evacuated, comprising:

pouring a molten metal from a molten metal inlet of a plunger sleeve;

following pouring of the molten metal from the inlet, moving a closure member toward the plunger sleeve to form a vacuum chamber surrounding the inlet and an open end of the plunger sleeve located on an opposite side of the plunger sleeve from where a casting die is positioned; and evacuating the vacuum chamber and the cavity, before starting an operation of a plunger tip, the plunger tip being operated by an actuator disposed outside of the vacuum chamber.

2. The vacuum die casting method according to claim 1, wherein at the start of the evacuation, the plunger tip is positioned between the open end of the plunger sleeve and the inlet so that the vacuum chamber is communicated to the inside of the plunger sleeve through the inlet.

3. A vacuum die casting apparatus for carrying out casting with a casting cavity evacuated, comprising:

a closure member forming a vacuum chamber by movement of the closure member toward a plunger sleeve, the vacuum chamber surrounding a molten metal inlet of the plunger sleeve and an open end of the plunger sleeve located on an opposite side of the plunger sleeve from where a casting die is positioned; and a mechanism for evacuating the vacuum chamber and the cavity, wherein a molten metal is poured from the inlet, followed by forming the vacuum chamber, and the evacuation of the vacuum chamber and the cavity starts before starting an operation of a plunger tip, wherein the closure member has an open end through which the open end of the plunger sleeve is inserted and having a closed end provided with a hole into which a shaft of the plunger tip inserts, and wherein the shaft of the plunger tip is actuated by an actuator disposed outside of the vacuum chamber.

4. The vacuum die casting apparatus according to claim 3, wherein at the start of the evacuation, the plunger tip is positioned between the open end of the plunger sleeve and the inlet so that the vacuum chamber is communicated to the inside of the plunger sleeve through the inlet.

5. The vacuum die casting apparatus according to claim 4, wherein the closure member is formed in a tubular shape;

wherein the internal dimension of the closure member is larger than the external dimension of the plunger sleeve; and wherein when the open end of the closure member is moved toward the moving direction of the plunger tip, the open end of the plunger sleeve is inserted into an internal space of the closure member.

6. The vacuum die casting apparatus according to claim 5, wherein the plunger sleeve is provided with a flange at an outer surface thereof, and the vacuum chamber is formed by pressing and fixing the open end of the closure member to the flange.

7. The vacuum die casting apparatus according to claim 5, wherein a fixing platen of the casting die is provided with a flange, and the vacuum chamber is formed by pressing and fixing the open end of the closure member to the flange.

8. The vacuum die casting apparatus according to claim 5, wherein the closure member, the plunger sleeve, the plunger tip and the shaft are arranged coaxially.

* * * * *